United States Patent [19]

Kaganowicz et al.

[11] 4,391,843

[45] Jul. 5, 1983

[54] ADHERENT PERFLUORINATED LAYERS

[75] Inventors: Grzegorz Kaganowicz, Princeton, N.J.; John W. Robinson, Levittown, Pa.

[73] Assignee: RCA Corporation, New York, N.Y.

[21] Appl. No.: 292,905

[22] Filed: Aug. 14, 1981

[51] Int. Cl.[3] ..... B05D 3/04; B05D 3/14

[52] U.S. Cl. ..... 427/41; 427/40

[58] Field of Search ..... 427/41, 40

[56] References Cited

U.S. PATENT DOCUMENTS

| | | | |
|---|---|---|---|
| 3,776,762 | 12/1973 | Bernath | 427/41 |
| 4,252,848 | 2/1981 | Datta et al. | 428/64 |
| 4,267,202 | 5/1981 | Nakayama | 427/40 |

FOREIGN PATENT DOCUMENTS

| | | | |
|---|---|---|---|
| 55-18548 | 5/1980 | Japan | 427/41 |

*Primary Examiner*—John D. Smith

*Attorney, Agent, or Firm*—Birgit E. Morris

[57] ABSTRACT

A method for forming a perfluorinated polymeric film having improved adhesion to a substrate surface whereby the substrate surface is initially glow discharged in the presence of nitrogen, and then a polymeric film is deposited on the substrate surface by subjecting the surface to a glow discharge in the presence of a precursor comprising a compound selected from the group consisting of perfluorocycloalkanes, perfluorocycloolefins and perfluoroalkyl-substituted derivatives thereof.

8 Claims, 1 Drawing Figure

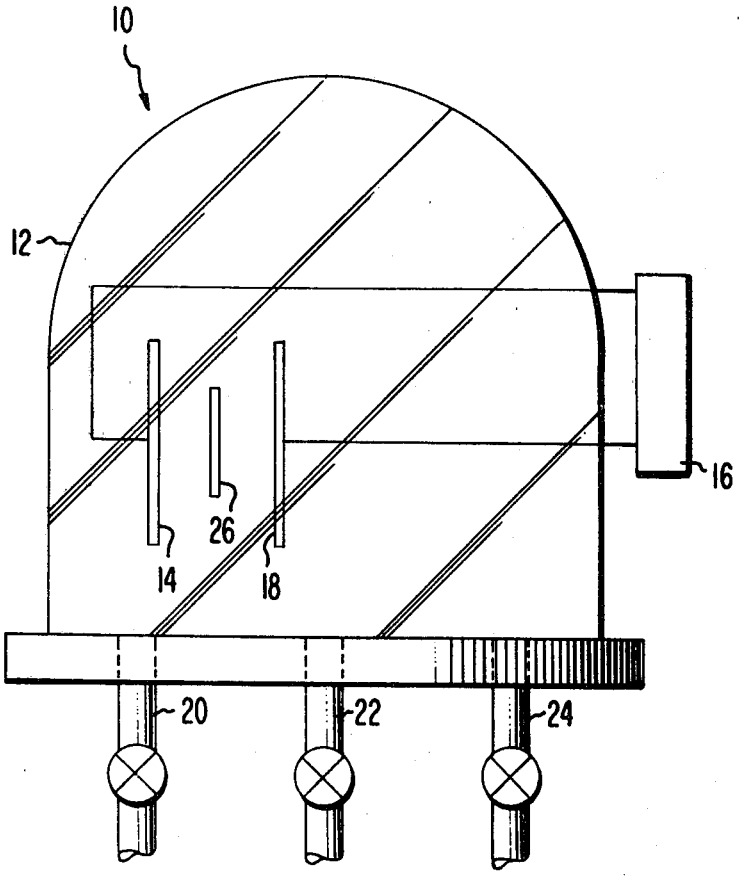
10
12
16
26
14
18
20
22
24

ADHERENT PERFLUORINATED LAYERS

This invention relates to a method of depositing by glow discharge techniques a low surface energy layer on a substrate. More particularly this method relates to the preparation of a low surface energy film having improved adhesion to the substrate.

BACKGROUND OF THE INVENTION

Datta et al. in U.S. Pat. No. 4,252,848, which is incorporated herein by reference, disclose a method for preparing low surface energy, perfluorinated polymeric films by glow discharging the substrate in the presence of perfluorocycloalkanes, perfluorocycloolefins or perfluoroalkyl-substituted derivative thereof. They found that films could be formed which adhere well to the substrate and which have a low surface energy. However, we have found that in certain applications where a more tenacious adherence of the perfluorinated film to the substrate is required some separation does occur. It would therefore be desirable to have a method for preparing perfluorinated polymer films having improved adhesion between the substrate and the film.

SUMMARY OF THE INVENTION

We have found that subjecting the substrate surface to a glow discharge of nitrogen results in a surface which is more adherent to the subsequently deposited perfluorinated polymer layer.

BRIEF DESCRIPTION OF THE DRAWING

The FIGURE is a cross-sectional view of an apparatus suitable for carrying out the method of this invention.

DETAILED DESCRIPTION OF THE INVENTION

We have found a method for forming a perfluorinated polymeric film having improved adhesion by first exposing the substrate surface to a glow discharge in the presence of nitrogen, and then depositing a polymeric film on the substrate by subjecting the surface to a glow discharge in the presence of a precursor comprising a compound selected from a group consisting of perfluorocycloalkanes, perfluorocycloolefins and perfluoroalkyl-substituted derivatives thereof. Following the nitrogen glow discharge treatment, the surface should be coated with the perfluorinated layer as soon as possible and without breaking vacuum in order to avoid contamination of the surface.

Metal substrates, such as cold-rolled steel or chromium can be employed, but other substrates including plastics should also be suitable. Further improvements in adhesion are observed when the perfluorinated starting material is glow discharge deposited in the presence of nitrogen. It is believed that during this deposition nitrogen is incorporated in the perfluorinated coating.

This invention will be further illustrated by reference to the Drawing. A glow discharge apparatus 10 suitable for carrying out the present method is shown in the FIGURE and includes a vacuum chamber 12 which can be a glass bell jar. In the vacuum chamber 12 are two electrodes, 14 and 18, which can be in the form of a screen coil, or plate of a material that is a good electrical conductor and does not readily sputter, for example, aluminum. A power supply 16, which may be DC or AC, is employed to obtain a voltage potential between the electrodes 14 and 18. The glow discharge plasma may be enhanced by means of magnets, not shown, on the electrodes 14 and 18. An outlet 20 from the vacuum chamber 12 allows for evacuation and is connected to a mechanical pump, not shown. A first inlet 22 and a second inlet 24 are connected to gas bleed systems, not shown, for adding the materials employed to prepare the desired adherent perfluorinated polymeric layer.

In carrying out the process a substrate 26 to be coated is placed between the electrodes 14 and 18 typically maintained about 5 to 10 centimeters apart. The vacuum chamber 12 is then evacuated through the outlet 20 to a pressure of about 0.5 to $1\times10^{-5}$ torr. Nitrogen is added through a first inlet 22 to a pressure of, preferably, about 5 to 500 millitorr. A voltage potential between the two electrodes 14 and 18 is created by activating the power supply 16. A glow discharge is initiated and is allowed to continue for about 10 to 200 seconds. The actual duration that the nitrogen glow discharge should continue may be empirically determined by measuring the adherence of the perfluorinated film. For the nitrogen glow discharge the current density should be in the range of 0.1 to 15 milliamps per square centimeter, preferably 1 to 5 milliamps per square centimeter. Any convenient frequencies such as 10 kilohertz or a radio frequency may be employed. The potential between the electrodes 14 and 18 is generally about 1,000 volts.

The vacuum chamber 12 is evacuated through the outlet 20 to a pressure of about 0.5 to $1\times10^{-5}$ torr. If nitrogen is to be added in the next step, the vacuum chamber 12 need not be evacuated. An inert gas, such as argon, or nitrogen, which may be incorporated into the resulting polymer, may be added through the first inlet 22 to a partial pressure of about 10 to 30 millitorr. The perfluorinated starting compound is added through a second inlet 24 to a total pressure of about 15 to 200 millitorr.

A glow discharge is then initiated between the electrodes 14 and 18 by energizing the power supply 16 in order to deposit the polymer film on the substrate 26. For deposition the current density should be in a range of 1–5 milliamps per square centimeter using 500 to 1,000 volts at a frequency of 10 kilohertz. Under these conditions the polymer will be deposited at the rate of about 250 angstroms per minute.

The invention will be further illustrated by the following examples, but it is to be understood that the invention is not to be limited to the details described therein. Pressures were measured using a Pirani gauge.

EXAMPLE 1

A 12 inch diameter chromium-coated stamper used to compression mold vinyl disc records was placed between two 15 centimeters by 15 centimeters aluminum electrodes 14 and 18 and a 46 centimeter by 76 centimeter bell jar vacuum chamber of a glow discharge apparatus 10, as shown in the FIGURE. The stamper was rotated at a rate of 30 revolutions per minute between these electrodes which covered a stripe approximately 6 inches wide on the 12 inch diameter stamper.

The bell jar was evacuated to a pressure of $1\times10^{-5}$ torr. Nitrogen was added to a partial pressure of 10 millitorr. To create a glow between the electrodes, the current density was 1–5 milliamps per square centimeter with a potential of 1,000 volts at a frequency of 10 kilohertz. The resulting glow discharge was allowed to continue for 30 seconds. The power was turned off and the ball jar again evacuated to a pressure $1\times10^{-5}$ torr.

The vacuum chamber was then backfilled with nitrogen to a partial pressure of 10 millitorr. Perfluoro-1,3-dimethyl-cyclohexane was then added through the second inlet to a total pressure of 40 millitorr. The power supply was activated so that the electrodes were operated with a current density of 1–5 milliamps per square centimeter at 1,000 volts at a frequency of 10 kilohertz. Polymer deposition begain and was continued until a layer about 300 angstroms thick was deposited.

The stamper was employed to compression mold video disc records from a styrene acrylonitrile copolymer. Multiple molded records separated easily from the stamper after pressing.

CONTROL

The materials, apparatus and procedures of Example 1 were employed except that the glow discharge in nitrogen prior to deposition of the perfluorinated coating was omitted. Attempts to press more than one record from the stamper resulted in the record sticking to the stamper surface. Since the record is quite tacky, it is believed that on the first pressing the perfluorinated coating adhered to the record, rather than the stamper. Therefore, when the second record was pressed, there was no perfluorinated layer present on the stamper surface to allow separation of the record.

EXAMPLE 2

The procedures, materials and apparatus of Example 1 were repeated except that the records were pressed from poly(vinyl chloride). Eight hundred video disc records were successfully compression molded. The records readily separated from the stamper and had the desired performane properties.

We claim:

1. In a method for forming a perfluorinated film comprising the step of depositing a polymeric film on a substrate surface by subjecting the surface to a glow discharge in the presence of a precursor comprising a compound selected from the group consisting of perfluorocycloalkanes, perfluorocycloolefins and perfluoroalkyl-substituted derivatives thereof;

the improvement which comprises the additional step of exposing the substrate surface to a glow discharge of a gas consisting essentially of nitrogen prior to the depositing step.

2. A method in accordance with claim 1 wherein the precursor additionally includes nitrogen.

3. A method in accordance with claim 1 wherein the precursor additionally includes argon.

4. A method in accordance with claim 1 wherein the compound is a perfluorocycloalkane.

5. A method in accordance with claim 1 wherein the compound is perfluoro-1,3-dimethylcyclohexane.

6. A method in accordance with claim 1 wherein the substrate surface is metal.

7. A method in accordance with claim 6 wherein the metal is cold-rolled steel.

8. A method in accordance with claim 6 wherein the metal is a chromium.

* * * * *